US006210092B1

(12) United States Patent
von Rohrscheidt

(10) Patent No.: US 6,210,092 B1
(45) **Date of Patent: *Apr. 3, 2001**

(54) PUNCH/BINDING MACHINE

(76) Inventor: Friedrich von Rohrscheidt, 2210 Walhala Dr., Richmond, VA (US) 22336

( * ) Notice: Subject to any disclaimer, the term of this patent is extended or adjusted under 35 U.S.C. 154(b) by 0 days.

This patent is subject to a terminal disclaimer.

(21) Appl. No.: 09/175,438

(22) Filed: Oct. 20, 1998

Related U.S. Application Data

(63) Continuation of application No. 08/598,682, filed on Feb. 8, 1996, now Pat. No. 5,827,034.

(30) Foreign Application Priority Data

Feb. 16, 1995 (DE) ..... 195 05 191

(51) Int. Cl.[7] ..... B42B 9/00

(52) U.S. Cl. ..... 412/40; 412/33; 412/39; 412/41; 412/43

(58) Field of Search ..... 412/33, 38, 39, 412/40, 41, 42, 43

(56) References Cited

U.S. PATENT DOCUMENTS 3,763,513 * 10/1973 Cooley ..... 11/1 A
5,143,502 * 9/1992 Kaufmann et al. ..... 412/16
5,273,387 * 12/1993 Groswith, III et al. ..... 412/40
5,306,047 * 4/1994 Otake et al. ..... 412/36
5,431,519 * 7/1995 Baumann .
5,549,433 * 8/1996 Byrne ..... 412/39
5,827,034 * 10/1998 Von Rohrscheidt ..... 412/20

FOREIGN PATENT DOCUMENTS

3919811 A1 * 12/1990 (DE) .
0 593 395 * 4/1994 (EP) .
93/09958 * 5/1993 (WO) .

* cited by examiner

*Primary Examiner*—Andrea L. Pitts
*Assistant Examiner*—Monica Smith Carter
(74) *Attorney, Agent, or Firm*—Jacobson, Price, Holman & Stern, PLLC

(57) ABSTRACT

A punch and binding machine including a punching mechanism and a binding mechanism for punching and binding a stack of sheets by spreading the curled fingers of an elastic binder. The binding mechanism has a longitudinal extension in parallel to the edge of the sheets and a binding handle. The punching handle for operating the punching system has the binding handle mounted to it so the binding handle can be rotated with respect to the punching handle. The binding mechanism may be a separate unit unattached to the punching mechanism.

8 Claims, 5 Drawing Sheets

4
92
86
82
84
70
90
76
80
96
94
88
78
98
60
62
64
14
8
10
6
100
68
1
2
16
18
20
22
24
26
28
30
32
34
36
38
40
42
44
46
48
50
51
52
54
56
58
59

PUNCH/BINDING MACHINE

This is a continuation of application Ser. No. 08/598,682, filed Feb. 8, 1996, now U.S. Pat. No. 5,827,034.

BACKGROUND OF THE INVENTION

This invention relates to a punch and binding machine for punching a stack of sheets and binding the sheets to known plastic ring-type paper binders.

Current paper binders have a longitudinal dorsal part, or spine, with fingers which are spaced along one side of the dorsal part protruding perpendicular from the longitudinal axis of the binder. Each of these fingers forms a loop, which can be inserted through the sheets to be bound. The fingers and the dorsal part are made from one piece of plastic. The fingers reach close enough to, or overlap, the other side of the dorsal part so that sheets cannot slide out. Such known paper binders are, e.g., the GBC presentation bindings for use with the GBC plastic binding system. The binders may also be of the type described in applicant's copending U.S. patent application Ser. No. 08/342,048 filed on Nov. 17, 1994, incorporated herein by reference.

For binding documents, the loops are spread by a binding mechanism so the fingers can be inserted through holes in the sheets to be bound.

Current punch/binding machines consist of a punching mechanism and of an attached binding mechanism. For punching, a number of sheets is inserted into a groove in the punching mechanism, then a lever is being pulled and its rotation is converted into a linear movement of the punching dies, which punch the sheets.

For spreading the fingers, the plastic binder is inserted into a row of bolts protruding from the binding mechanism with these bolts reaching into the spaces between the fingers and thereby holding the binder parallel to its longitudinal axis.

Binding mechanisms on conventional punch/binding machines have a second spreading device with a row of hooks. By pushing the lever, through which also the punching is done, the hooks are being moved along the direction of the longitudinal axis of the binder and then perpendicular to it, so they open the fingers of the binder. Then the sheets can be put onto the fingers and the binder can be closed again.

Conventional punch/binding machines are relatively heavy and expensive since they need a mechanism that translates the rotational movement of the binding lever into a linear movement of the hooks, first in parallel to the axis of the binder and then perpendicular to it.

SUMMARY OF THE INVENTION

The present invention provides a solution to the task by designing a punch/binding machine that is light weight, that consists of few parts, that is economical to manufacture and that is easy to use. Furthermore the binding mechanism may be attached to the punching mechanism in an easy way or the binding mechanism may be a separate unit.

With a punch/binding machine according to this invention no complex transmission mechanisms are necessary, since opening the binder is achieved through a simple rotation of a spreading device. Hereby, the number of parts of the punch/binding machine can be kept low, which makes the machine light weight and economical to produce.

BRIEF DESCRIPTION OF THE DRAWINGS

The invention is subsequently described through an example with reference to the accompanying drawings.

DETAILED DESCRIPTION OF THE PREFERRED EMBODIMENTS

Figure 1:
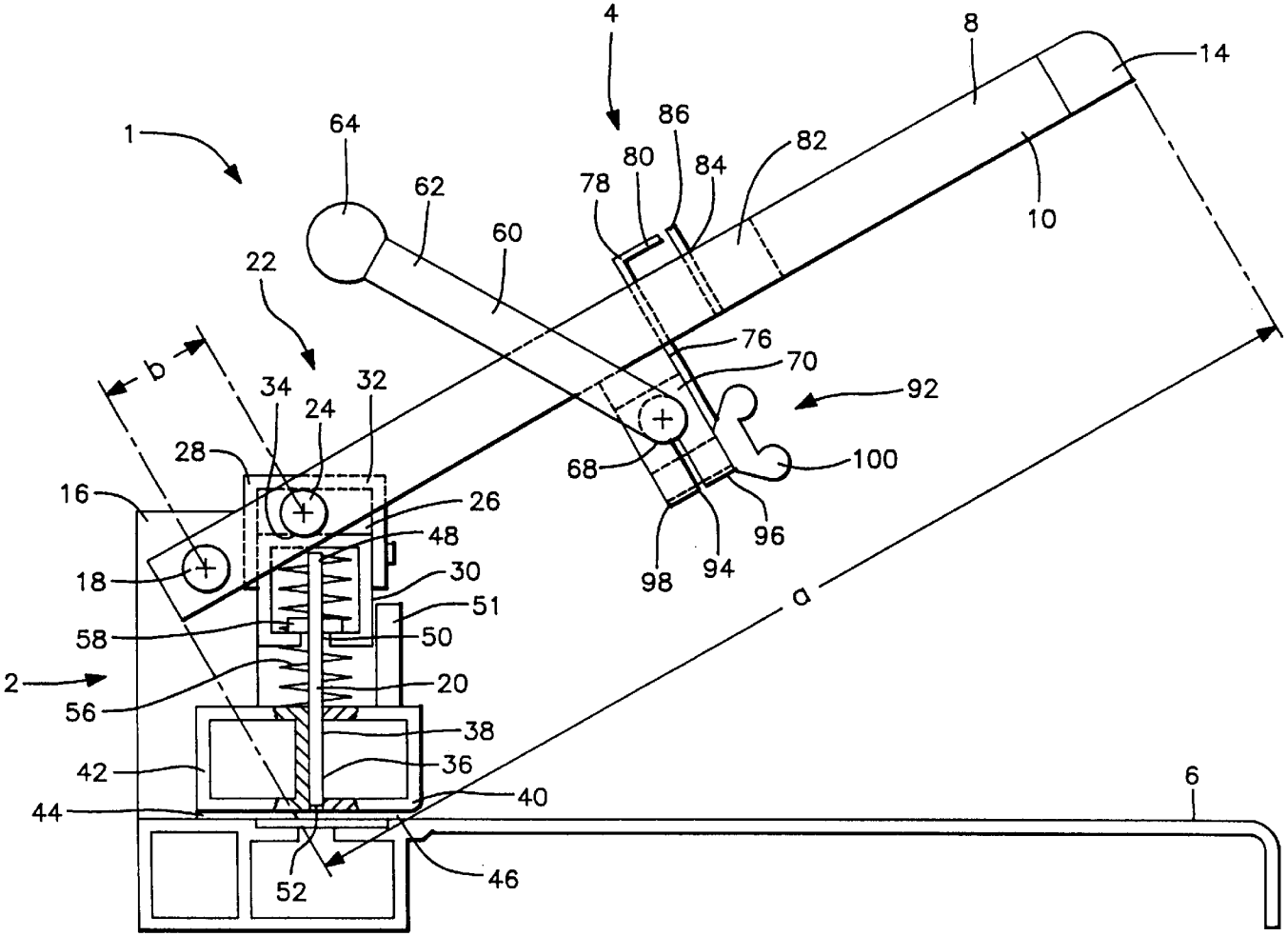
FIG. 1 is a side view of a punch/binding machine according to the invention with the punching mechanism in an open position and the binding mechanism in a closed position.

The punch/binding machine 1 pictured in side view in FIG. 1 is used for punching and binding a stack of sheets. The punch/binding machine comprises a punching mechanism 2 and a binding mechanism 4.

Figure 2:
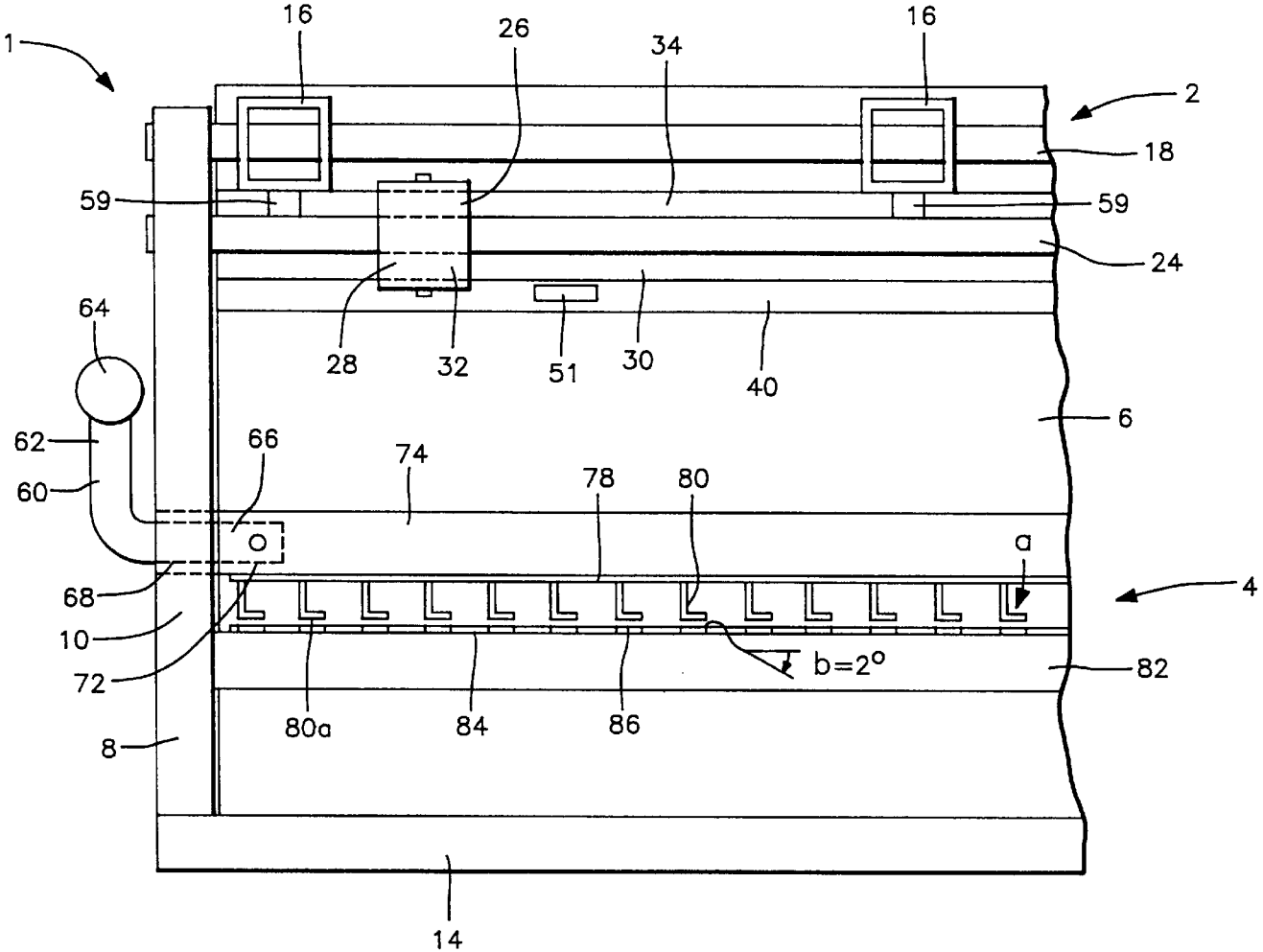
FIG. 2 is a plan view of the punch/binding machine according to FIG. 1.

The punching mechanism 2 has a rectangular console 6 and a U-shaped punching lever 8. The punching lever 8 consists of a left punching lever beam 10 and of a parallel right punching lever beam 12. Both have the length "a". The cross member 14 is parallel to the longitudinal direction of the console 6 and connects the punching lever beams 10 and 12 as shown in FIG. 2.

Three square pillars 16 reach up from the console and are spaced along the longitudinal direction of the console holding the punching axis 18. The ends of the punching axis 18 are connected to the punching beams 10 and 12, so the punching handle 8 can be rotated around the pillars 16 as shown in FIG. 1 and FIG. 2.

For punching operation the rotation of the punching handle 8 has to be converted into a linear movement of the plural punching dies 20. This is done through the linear guide 22. The linear guide 22 consists of a roller 24, which is connected to the punching beams 10 and 12 and can rotate freely around its mounts. The axis of the roller 24 is parallel to the punching axis 18 and spaced from it by the distance "b". The linear guide consists furthermore of the outer guiding frame 26, which guides the roller 24. The outer guiding frames 26 are being formed by two U-shaped rails 28 connected to a square tube 30, which is parallel to the roller 24. The flanges of the U-shaped rails 28 are flush with the vertical walls of the square tube 30 and overlap them. Between the cross members 32 of the U-shaped rails 28 and the upper wall of the square tubing 30, two chambers are being formed which are open in the longitudinal direction of the square tubing 30 and form the guiding frame 26 of the linear guide 22. The rollers 24 protrude into these chambers, so they can roll in the guiding frame 26. Thereby, the guiding frame 26 is engaged with the roller 24, which is connected to the punching handle 8 through the punching lever beams 10 and 12.

The punching dies 20 are guided in vertical grooves 36. The grooves 36 are machined into the vertical wall of a second square tubing 40 and spaced along its longitudinal direction. The guiding grooves are as deep as the thickness of the punching dies. A third square tubing 42, which is connected flush with the vertical wall 38 of the second square tubing 40 holds the punching dies 20 in their guiding slots 36, but allows them to slide freely in a vertical direction.

The third square tubing 42 is mounted to the console 6 on top of a strip 44, which is not as wide as the bottom side of the square tubing 42. This creates a groove 46 between the surface of the console and bottom side of the second square tubing 40 and part of the bottom side of the third square tubing 42. The upper ends 48 of the punching dies 20 reach through a longitudinal slot 50 in the bottom side of the first square tubing 30 into the interior of the first square tubing 30 and close to the interior upper wall of the square tubing 30. The movement of the first square tubing 30 is guided on its backside by the vertical surfaces of the pillars 16 and on its front side by the vertical guides 51.

Figures 4, 5:
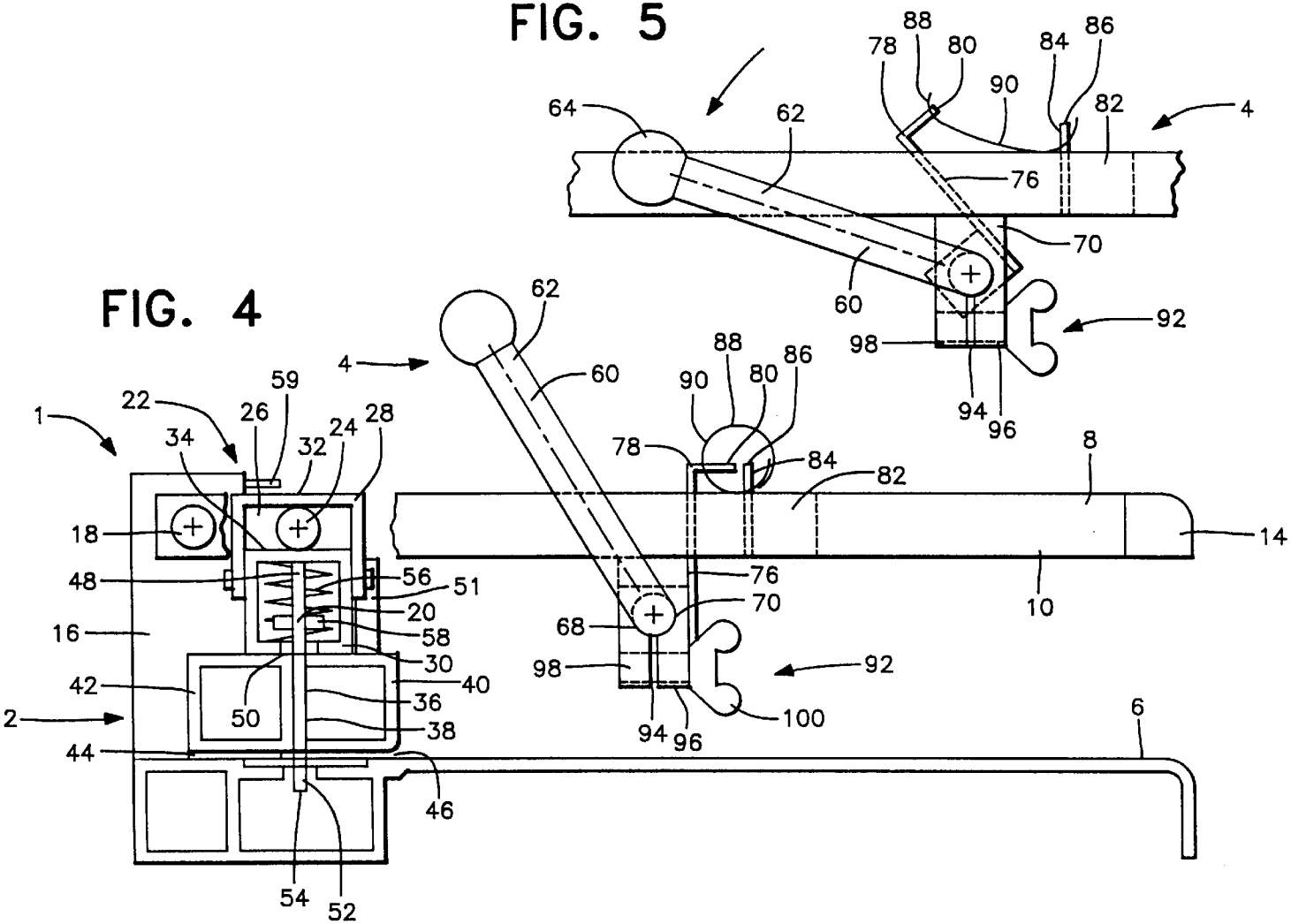
FIG. 4 is a side view of the punch/binding machine according to FIG. 1 with a binder engaged into the binding mechanism in a closed position.
FIG. 5 is a cutout view of FIG. 4 with the binding mechanism in an open position.

For punching, a stack of sheets is inserted into the groove 46 and the punching handle 8 is pressed down. Thereby, the rollers 24 connected to the punching levers 10 and 12 are being moved downwards on a circular track around the punching axis 18. The rollers 24 roll in the guiding frames 26 in a horizontal direction pressing down on the upper wall 34 of the first square tubing 30, which moves downward together with the rollers 24. The interior of the upper wall 34 of the first square tubing 30 gets in contact with the upper ends 48 of the punching dies 20 pressing them downwards with their lower ends protruding from the guiding slots 36, punching through the stack of sheets. This depressed position of the punch/binding machine is shown in FIG. 4.

Figure 3:
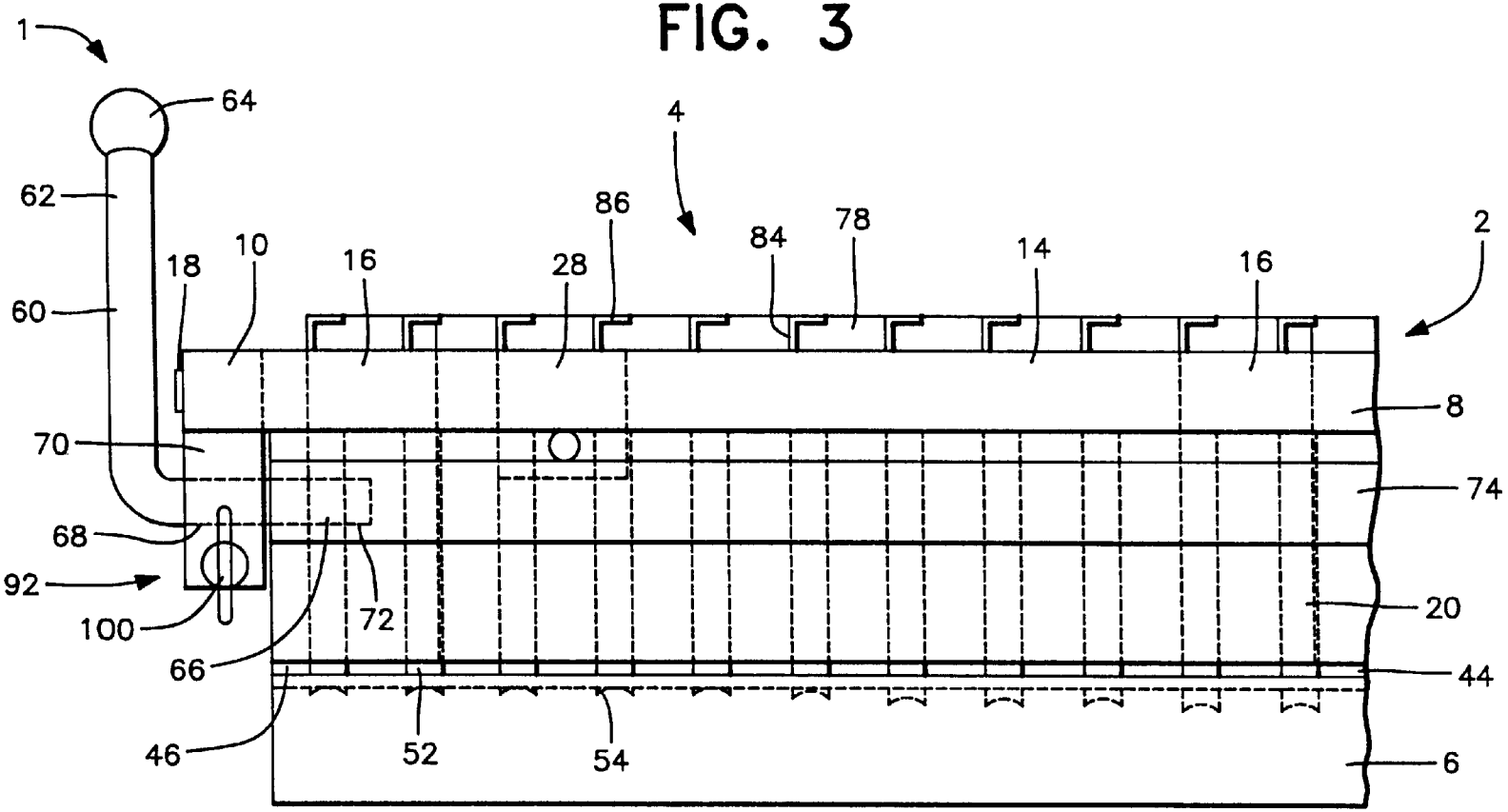
FIG. 3 is a frontal view of the punch/binding machine according to FIG. 1 with the punching mechanism in a closed position and the binding mechanism in a closed position.

The punching dies 20 have a rectangular cross section and their lower ends 54 have a concave cutting edge as shown in FIG. 3. Through their concave cutting edge the dies penetrate the stack of sheets easier since the cut is done gradually.

In order not to have to use excessive force when punching thick documents an advantageous leverage has to be employed. Therefore, the distance "b" between the rollers 24 and the punching axis 18 is small in comparison with the length "a" of the punching levers 10 and 12 as shown in FIG. 1. In order to further reduce the force necessary for punching thick documents the total length of the punching dies 20 between their lower ends 52 and their upper ends 48 is varied from punching die to punching die so that only one third of the punching dies is actually punching at one moment in time. The distance between the lower ends 52 of the punching dies and the retrieval pins 58 is constant. The length variation of the punching dies 20 is done between their upper ends 48 and their retrieval pins 58.

In order to make sure that the punching handle 8 returns into its start position, several springs 56 are being used which press against the inner side of the upper wall 34 of the first square tubing 30 with one end and against the outer upper walls of the second and third square tubing 40 and 42. The springs are preloaded in the open position of the punching mechanism shown in FIG. 1. The springs reach through holes in the bottom side of the first square tubing 30.

In order to be able to pull the punching dies 20 out of a stack of sheets after punching, retrieval pins 58 reach through the wider side of the punching dies 20. These retrieval pins 58 are longer than the width of the slot 50 in the bottom of the first square tubing 30, so they can hold against the bottom wall of the first square tubing 30 from the inside.

After punching, when letting go of the punching lever 8, the first square tubing 30 is pressed upwards through the vertical expansion of the springs 56. The retrieval pins 58 are pulled up by the interior bottom side of the first square tubing 30 thereby pulling the punching dies 20 upwards out of the stack of sheets. An elevation limiter 59 is attached to the pillars 16 limiting the upward movement of the first square tubing 30.

The binding mechanism 4, which is attached to the punching mechanism 2 (but may be a separate unit) consists of an L-shaped binding handle 60, with its binding lever 62 protruding above the punch lever 10 on the left side of the machine. The free end of the binding lever carries a button 64 for easier handling. The other end 66 of the binding handle 60 is held in a bearing 68 in the binding handle mount 70. The rotation axis of the binding handle 60 is parallel to the punching axis 18. The binding handle mount 70 is connected with the punch lever between the cross member 14 and the punch axis 18 protruding downward from the punch lever as shown in FIG. 1 and in FIG. 3. Thereby, the binding handle 60 is connected to the punch handle 8 so it can be rotated.

The other free end 66 of the binding handle 62 reaches into a bore 72 of a first square rod 74 and is connected to it as shown in FIG. 2 and FIG. 3. Hereby and through another bearing attached to the binding lever 12, which is not shown in FIG. 2, the first square rod 74 can be rotated in reference to the punch handle 8 in between the two punch levers 10 and 12 with the axis of the first square rod 74 being parallel to the punch axis 18.

On the surface of the first square rod 74, which points towards the cross member 14, a plate 76 is mounted, reaching upwards between the punch levers 10 and 12. At the upper end of the plate 76, a first spreading device 78 is connected in a perpendicular manner pointing towards the cross member 14 of the punch handle 8. Hereby, the binding handle 60 is connected with the first square rod 74 and with the plate 76 and hereby with the first spreading device 78. The first spreading or opening device 78 has a row of hooks 80 spaced along its longitudinal extension as shown in FIG. 2. The plane of these first hooks 80 is in parallel with the plane of the punch handle 8 when the binding mechanism is closed as shown in FIG. 1 and has a second perpendicular extension 80*a* parallel with the axis of rotation of the first square rod 74.

A second square rod 82 is connected with the punch handle in between the first square rod 74 and the cross member 14, in parallel to the first square rod 74.

From this second square rod 74 a second spreading device 84 protrudes upwards. The second spreading device 84 has a second row of hooks or extensions 86, which are in a plane perpendicular to the plane of the punch handle 8. As shown in FIG. 1, the plane of the first hooks 80 is perpendicular to the plane of the second hooks 86 when the binding mechanism is closed. The first hooks 80*a* of the first spreading device 78 and the second hooks 86 of the second spreading device 84 point into the same direction and are perpendicular to each other.

For opening a binder, the fingers 88 of a binder 90 (such as a conventional binder or the binder disclosed in the above-referenced copending patent application) are being simultaneously engaged into the first hooks 80 (80*a*) of the first spreading device 78 and into the second hooks 86 of the second spreading device 84 as shown in FIG. 4. The first hooks 80*a* and the second hooks 86 are apart from each other by a smaller distance than the diameter of the binder, so the curled fingers 88 of the binder 90 slip over the hooks 80*a* and 86.

In order to make sure the elastic fingers 88 of the binder 90 do not slip off the hooks 80, 86 when being spread, the ends of the first hooks may be tilted inwards by about 2 degrees in the direction of the spreading force, i.e. towards the direction of opening as shown in FIG. 2 where the angle "a" is approximately 88 degrees. The second hooks are also tilted by 2 degrees in the direction of the spreading force perpendicular to their plane, i.e. where the angle "b" may be approximately 2 degrees.

For spreading the fingers 88 of a binder 90, the binding handle 60 is taken by its button 64 and rotated so that the first spreading device 78 is rotated away from the second spreading device 84 and the curled fingers 88 of the binder 90 are being opened as shown in FIG. 5. Hereby the fingers 88, which are curled when the binder is closed, are being partially straightened, so that the sheets which have been punched before can be pushed onto the ends of the fingers 88.

In order to be able to keep the spread fingers 88 open without having to hold the binding handle 60, a friction lock 92 is being employed, which can be used to arrest the binding handle 60 in any angular position in reference to the punch handle 8. Therefore, the binding handle mount 70 has a slot 94, which reaches from the bearing bore to the free end of the binding handle carrier dividing the binding handle carrier in two binding handle carrier flanges 96 and 98. A tightening bolt 100 reaches through the slot between the two binding handle mount flanges 96 and 98. The tightening bolt 100 reaches through a smooth bore in the flange 96 and is threaded in the other flange 98. By tightening the bolt 100, the two binding handle mount flanges 96 and 98 are pressed together and the binding handle 60 is locked tight in its bearing and thereby locked into position.

After inserting the sheets into the binder, the friction lock bolt 100 is loosened and the binding handle 60 is returned into its closed position. The fingers 88 of the binder 90 curl through their elasticity into a closed loop and thereby bind the sheets.

Figure 6:
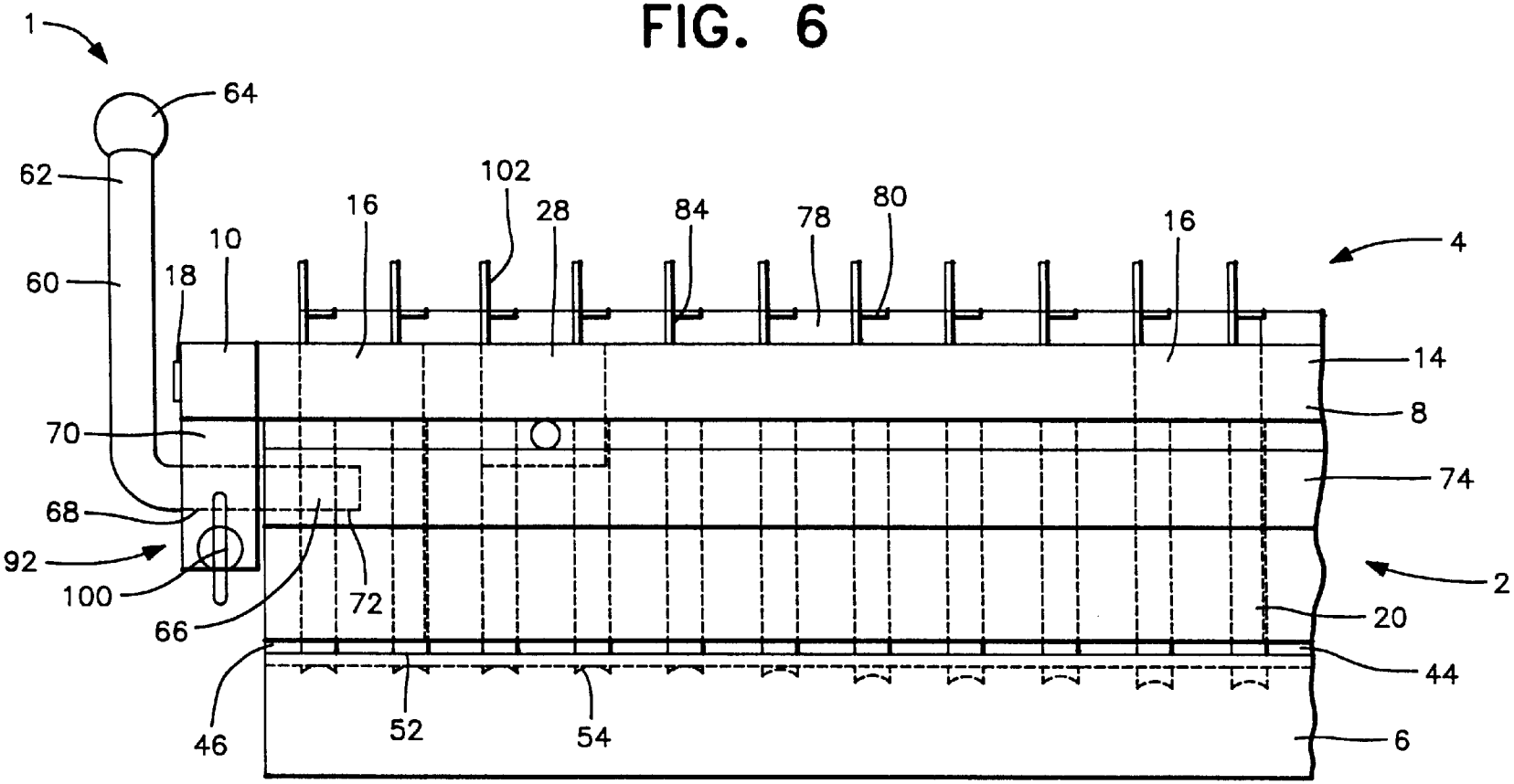
FIG. 6 is a frontal view of another variant of the punch/binding machine according to the invention with the binding mechanism in a closed position.

Instead of the hooks 86, the second spreading device 84 can also have retaining bolts (upright extensions) 102, as shown in FIG. 6, which protrude vertically upwards and overlap with the extensions 80*a* of the first hooks 80 of the first spreading device 78. For opening, the binder 90 is inserted into the binding mechanism 4, so the retaining bolts 102 reach in between the fingers 88 holding against the dorsal part of the binder 90.

With the binding mechanism 4, according to this invention binders 90 of various diameters can be opened and closed again.

What is claimed is:

1. A punch/binding machine comprising a punching mechanism for punching a stack of sheets to form a plurality of holes adjacent an edge of the sheets and a binding mechanism for binding the sheets with a plastic binder having a longitudinal spine and a plurality of extendible curled fingers forming loops to bind the sheets to the plastic binder, said curled fingers being spreadable to open the loops, said binding mechanism comprising a first spreading member for engaging the curled fingers of the plastic binder and a second spreading member for engaging the longitudinal spine of the plastic binder, said first and second spreading members being angularly displaceable with respect to each other for spreading open the loops of the plastic binder.

2. A punch/binding machine according to claim 1 wherein said first spreading member has a longitudinal extension parallel to the longitudinal spine of the binder and a row of hooks spaced along said longitudinal extension.

3. A punch/binding machine according to claim 1 wherein said second spreading member has a longitudinal extension parallel to the binder and a row of retaining bolts spaced along said longitudinal extension.

4. A punch/binding machine according to claim 2 further comprising a handle interconnected with one of said first and second spreading members for angularly displacing said first and second spreading members with respect to each other.

5. A punch/binding mechanism according to claim 3 wherein said row of hooks and said row of retaining bolts are angularly displaceable so as to move relative to each other substantially circumferentially.

6. A binding machine for binding a sheaf of papers having a plurality of punched holes adjacent one edge of the sheaf with a plastic binder having a longitudinal spine and a plurality of extendible fingers perpendicular to the spine and forming loops to bind the sheaf to the plastic binder, the binding machine comprising an angularly displaceable first support member defining a longitudinal axis and a fixed second support member defining a longitudinal axis, the longitudinal axes of said first and second support members substantially parallel to each other, a first spreading member comprising a plurality of hooks having first extensions substantially parallel to the longitudinal axes, said first extensions engageable with the extendible fingers of the plastic binder, a second spreading member comprising a plurality of retaining elements for engaging the longitudinal spine of the plastic binder, wherein one of said first and second spreading members is connected with said angularly displaceable first support member and the other of said first and second spreading members is connected with said fixed second support member such that said first extensions of said first spreading member and said retaining elements of said second spreading member move toward and away from each other along a substantially circumferential arc upon angular displacement of said first support member.

7. A binding machine as claimed in claim 6 wherein said plurality of retaining elements of said second spreading member comprise a plurality of upstanding extensions spaced apart in a direction along the longitudinal axes.

8. A binding machine as claimed in claim 7 wherein said upright extensions are disposed between the extendible fingers of said plastic binder and are engageable with the spine of said plastic binder.

* * * * *